US005140339A

United States Patent [19]

Higuma et al.

[11] Patent Number: 5,140,339

[45] Date of Patent: Aug. 18, 1992

[54] INK JET RECORDING WITH EQUAL AMOUNTS OF MONO- AND MIXED COLOR DROPLETS

[75] Inventors: Masahiko Higuma, Sagamihara; Kenji Hasegawa, Isehara; Takahiro Mori, Ayase, all of Japan

[73] Assignee: Canon Kabushiki Kaisha, Tokyo, Japan

[21] Appl. No.: 593,258

[22] Filed: Oct. 1, 1990

Related U.S. Application Data

[63] Continuation of Ser. No. 304,905, Feb. 2, 1989, abandoned, which is a continuation of Ser. No. 171,466, Mar. 21, 1988, abandoned.

[30] Foreign Application Priority Data

Mar. 23, 1987 [JP] Japan ..... 62-065756
Mar. 17, 1988 [JP] Japan ..... 63-064316

[51] Int. Cl.[5] ..... B41J 2/21
[52] U.S. Cl. ..... 346/1.1; 346/140 R
[58] Field of Search ..... 346/1.1, 140, 75, 135.1

[56] References Cited

U.S. PATENT DOCUMENTS 4,521,805 6/1985 Ayata ..... 358/296 X
4,617,580 10/1986 Miyakawa .
4,630,076 12/1986 Yoshimura ..... 346/140
4,631,548 12/1986 Milbrandt ..... 346/140 X
4,666,757 5/1987 Helinski ..... 346/135.1 X
4,721,968 1/1988 Arai ..... 346/140 X
4,785,313 11/1988 Higuma ..... 346/135.1
4,832,984 5/1989 Hasegawa ..... 346/1.1 X

FOREIGN PATENT DOCUMENTS 211458 12/1983 Japan .

*Primary Examiner*—Joseph W. Hartary
*Attorney, Agent, or Firm*—Fitzpatrick, Cella, Harper & Scinto

[57] ABSTRACT

An ink-jet recording process is provided which comprises applying inks to a recording medium having at least an ink-transporting layer and an ink-retaining layer, from the ink-transporting layer side of said recording medium, and thereby forming with a plurality of ink dots a unicolored area observable from the ink-retaining layer side, the dots being formed respectively by application of at least two ink droplets in superposition.

A mixed color dot is similarly formed, wherein the amount of ink forming the unicolor dot and the mixed color dot is about the same to provide similar image density, resolution and uniformity.

12 Claims, 1 Drawing Sheet

INK JET RECORDING WITH EQUAL AMOUNTS OF MONO- AND MIXED COLOR DROPLETS

This application is a continuation of application Ser. No. 304,905 filed Feb. 2, 1989, which is a continuation of application Ser. No. 171,466, filed Mar. 21, 1988, now abandoned.

BACKGROUND OF THE INVENTION

1. Field of the Invention

The present invention relates to an ink-jet recording process. More particularly, it is concerned with an ink-jet recording process for obtaining a color image of high image quality with a high recording density, using plural inks with different hues.

2. Related Background Art

In ink-jet recording processes, recording is carried out by forming ink droplets according to various ink-ejection methods exemplified by the electrostatic attraction method, a method of mechanical vibration or displacement by use of a piezoelectric element, a method of using pressure generated by heating and foaming ink and so forth; and expelling the droplets so that some or all of them adhere on a recording medium such as paper. These are noted as recording methods that can perform high-speed printing and multi-color printing with minimal noise generation.

As the inks for ink-jet recording, those chiefly comprising water are used in view of safety and recording performance, and polyhydric alcohols are often added thereto to prevent nozzle clogging and improve ejection stability.

In instances in which color images are formed by using the ink-jet systems and inks as mentioned above, generally used are cyan (C), magenta (M), yellow (Y) and/or black (Bk) inks to produce each corresponding monochrome at given positions on the recording medium. When neutral tints (mixed colors) thereof are produced, plural ink droplets having different hues are applied in superposition or on mutually overlapping sites on the recording medium.

On the other hand, to obtain shades of recorded images, it is generally practiced to control the application density (an areal gradation method).

The recording medium used for forming color images thereon by the above ink-jet systems include ordinary paper such as wood free and bond paper, coated paper comprising a support having a porous ink-absorptive layer typified by ink-jet paper (Japanese Patent Laid-open Publication No. 214989/1985), etc.

Since the images recorded with these recording media are viewed from the ink-applying surface (the surface on which inks are applied), they are constructed so that as much recording agents remain on such surface as possible, thus having the disadvantage that the durability such as water resistance and abrasion resistance and storage stability of images are inferior and the disadvantage that a recorded image cannot have satisfactory gloss.

A measure to solve such problems is a recording medium disclosed, for example, in Japanese Patent Laid-open Publication No. 136480/1983 and Japanese Patent Laid-open Publication No. 136481/1983. This recording medium comprises a support provided thereon with an ink-receiving layer chiefly comprised of a pigment having a refractive index of 1.58 or less, where the images formed are viewed from the support side. In this method, difficulties in the various performances such as water resistance at the image-viewing surface (the surface from which images are viewed) are sufficiently resolved. However, since the ink-receiving layer is chiefly comprised of the pigment and is contiguously laminated on a transparent support, a large part of the inks which reach to the support is veiled by the pigment even when the pigment has a refractive index of 1.58 or less) making it impossible to sufficiently enhance the image density at the image-viewing surface.

Recently, for higher speed and higher grade recording using ink-jet recording apparatus, recording media also are required to have highly improved recording performances.

More specifically, recording mediums are now to the demanded which have superior to the recording performances such as ink absorbing property, color-developing property for dyes, light-resistance of recorded images, resolution, color performance, recorded image density, storage stability, and gloss.

The present inventors have investigated in order to provide such recording mediums as stated above, and, as a result, have ever proposed a recording medium having a specific constitution such that it comprises a liquid-permeable ink-transporting layer and an ink-retaining layer wherein the ink-applying surface and the image-viewing surface are in an obverse and reverse relationship (EP 227 245 A2).

However, in attempting to obtain color images having a high recording density by using the above recording medium color was insufficiently formed because of the small quantity of ink droplets applied at the monochrome producing areas, resulting in color-forming performances being non-uniform at the neutral tint producing areas.

More specifically, to form a color image using plural kinds of inks of different hues, as many as four droplets may be applied in superposition on one site to develop a neutral tint, while only one ink droplet is applied to develop a unicolor tone. When the number of the ink droplets to be applied varies at every site like this, the ink penetration through the ink-transporting layer also varies depending on the number of the ink droplets, so that the quantity of ink penetrating to the ink-retaining layer to produce an image varies. Moreover, since the ink droplets ejected from an ink-jet nozzle at one time are stagnate in the ink-transporting layer (particularly at the unicolored producing area and therefore little ink may reach the ink-retaining layer. This causes the problems such that there can not be obtained images with uniform color-forming performance, high density and high resolution.

SUMMARY OF THE INVENTION

Accordingly, an object of the present invention is to provide an ink-jet recording process for readily obtaining a color image of high image quality with a superior image density, uniform color-forming performance and resolution, with high recording density, relating to an ink-jet recording process comprising applying ink droplets from the ink-retaining layer side of a recording medium having at least an ink-transporting layer and an ink-retaining layer to form on the ink-retaining layer an image that can be viewed from the ink-retaining layer side.

The above object can be achieved by the invention described below.

According to an aspect of the present invention, there is provided an ink-jet recording process comprising applying inks to a recording medium having at least an ink-transporting layer and an ink-retaining layer, from the ink-transporting layer side of said recording medium, and thereby forming with a plurality of ink dots a unicolored area observable from the ink-retaining layer side, the dots being formed respectively by application of at least two ink droplets in superposition.

According to another aspect of the present invention, there is provided an ink-jet recording process comprising applying inks to a recording medium having at least an ink-transporting layer and an ink retaining layer, from the ink-transporting layer side of said recording medium, and thereby forming with a plurality of ink dots in a density of 200×200 DPI (dots per inch) or more a unicolored area observable from the ink-retaining layer side, the dots being formed respectively by application of at least two ink droplets in superposition.

According to a further aspect of the present invention, there is provided an ink-jet recording process comprising applying inks to a recording medium having at least an ink-transporting layer and an ink-retaining layer from the ink-transporting layer side of said recording medium, and thereby forming with a plurality of ink dots a unicolored area and a mixedly colored area which are observable from the ink-retaining layer side, the dots being formed respectively by application of at least two ink droplets in superposition.

DETAILED DESCRIPTION OF THE PREFERRED EMBODIMENTS

Figure 1:
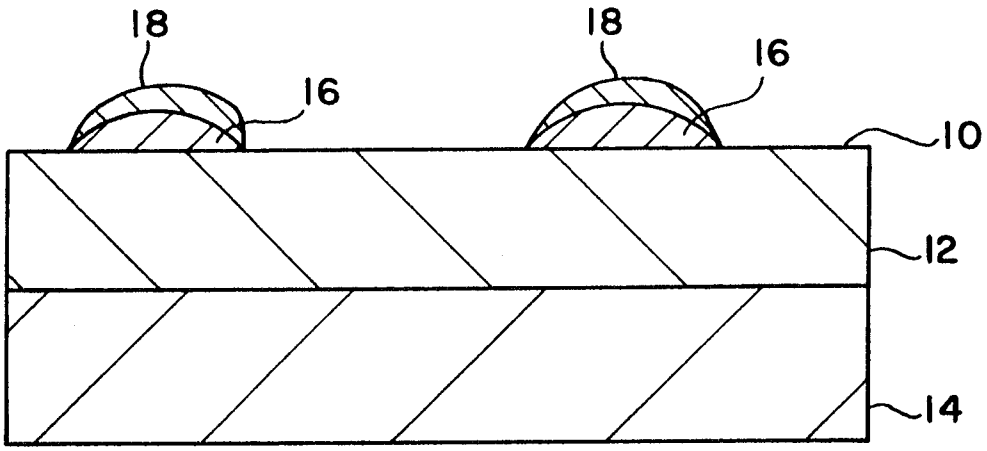
FIG. 1 is a schematic view illustrating a plurality of superposed ink droplets applied to a recording medium in accordance with the invention.

The present inventors have found that where images are formed by applying inks to a recording medium having at least an ink-transporting layer and an ink-retaining layer, plural ink dots which form images may be formed by applying at least two ink droplets in superposition, whereby the quantity of ink reaching the ink-retaining layer can be made uniform as a whole even when the ink droplets ejected from one ink-jet nozzle in one time are small, thus solving the above problems with great ease.

More specifically, assume that color images are formed at a recording density of as high as 200×200 DPI (dots per inch) or more in length direction and in breadth direction each, preferably from 200×200 to 600×600 DPI, with a plurality of inks having different hues, using a recording medium of the type in which images are not viewed from the ink-applying surface. Further assume that the ink-applying surface and the image-viewing surface are different, and have at least an ink-transporting layer and an ink-retaining layer. In such an instance, the ink droplets applied at a particular site of the recording medium are not necessarily applied in a constant quantity, and a plurality of inks having different hues are superposed to form the respective dots according to image signals and, in a neutral tint area, depending on desired neutral tints. Therefore the number of ink droplets applied is different in each dot. Moreover, the ink droplets ejected from one ink-jet nozzle in one time are small quantity for carrying out the recording with a high density as much as 200×200 DPI or more.

Accordingly, the ink-transporting property and the ink absorption ability of the ink-transporting layer and the ink-retaining layer, respectively, vary at every site, causing the problems that some parts bear small quantity of ink droplets applied so that the inks may not sufficiently reach the ink-retaining layer, that the desired neutral tints are not produced, and so forth, resulting in unsatisfactory color-forming performance, uniformity and resolution of images.

The above problems would be settled if the physical properties of the ink-transporting layer and ink-retaining layer could be varied according to the number of the ink droplets applied at particular sites on the recording medium, but, this is not possible in practice.

In contrast, of the recording medium of the present invention has the constitution as previously described wherein respective dots are formed by applying a plurality of ink droplets in superposition when unicolored areas and neutral tint (mixedly colored) areas are formed with a plurality of ink dots on the ink-retaining layer by the inks applied from the ink-transporting layer side. Namely, the number of the ink droplets applied in superposition to form the respective dots is at least two, approximating to the maximum number of ink droplets applied, which is four. As a result, the inks that tend to stagnate in the ink-transporting layer because of small quantity can be sufficiently forwarded to the ink-retaining layer and also, in respect of insufficiency in dot shapes, the dot shapes are improved, thus obtaining high quality color images with a high recording density, having superior color-forming performance for neutral tints, uniformity in images, etc.

The present invention will be described below in greater detail by giving preferred embodiments of the present invention.

The recording medium used in the present invention is constituted of a substrate as a support, an ink-retaining layer formed on said substrate and on which inks or dyes are substantially absorbed and captured to form colors, and an ink-transporting layer formed on the ink-retaining layer and which has liquid-permeability to inks, transports the inks applied, to the ink-retaining layer and is itself not substantially dyed.

The substrate is not necessarily required if the ink-transporting layer or ink-retaining layer also function as a substrate.

Any conventionally known materials can be used as the substrate used in the above recording medium, specifically including plastic films or sheets made of polyester resin, diacetate resin, triacetate resin, polystyrene resin, polyethylene resin, polycarbonate resin, polymethacrylate resin, cellophane, celluloid, polyvinyl chloride resin, polyvinylidene chloride resin, polysulfone resin, polyimide resin or the like, or glass sheet, etc. There is no particular limitation in the thickness of these substrates, but, in general, it may range from 1 μm to 5,000 μm, preferably from 3 μm to 1,000 μm, more preferably from 5 μm to 500 μm.

Any processing may also be applied to the substrates to be used. For example, it is possible to apply a desired pattern, appropriate gloss or a silky pattern on the substrates. It is also possible to select as the substrate those having water resistance, abrasion resistance, blocking resistance or the like to impart the same to the image-viewing surface of the recording medium.

The ink-transporting layer constituting the recording medium used in the present invention is required at least to have liquid-permeability. The liquid-permeability mentioned in the present invention refers to a property of rapidly passing inks and causing substantially no dyeing in the ink-transporting layer by the dyes contained in inks. A preferred embodiment for improving the liquid-permeability of the ink-transporting layer is to have the porous structure wherein cracks or through-holes are present inside the ink-transporting layer.

In instances in which the images obtained by the recording medium of the present invention are viewed from the opposite side to the ink-applying surface as previously mentioned, the ink-transporting layer may preferably have light diffusibility.

The ink-transporting layer satisfying the above properties may have any constitution so long as it has the above properties, but may preferably be chiefly constituted of particles free from being dyed and binder.

Such particles may be any particles so long as they may substantially not be dyed by dyes or the like contained in inks. Considering that the dyes in inks are water-soluble in general, particularly suitable particles in the recording medium used of the present invention include organic particles of highly hydrophobic thermoplastic resins, thermosetting resins or the like, as exemplified by powders of resins such as polystyrene, polymethacrylate, polymethyl methacrylate, elastomers, an ethylene/vinyl acetate copolymer, a styrene/acrylate copolymer, polyester, polyacrylate, polyvinyl ether, polyamide, polyolefin, polyimide, guanamine resins, SBR, NBR, MBS, polytetrafluoroethylene, urea, polyvinyl chloride, polyacrylamide and chloroprene, and emulsions or suspensions of one or more of these is used as desired.

For the purpose of increasing the whiteness of the ink-transporting layer, there may be also added white inorganic pigments to the extent that the ink-permeability of the ink-transporting layer may not be impaired, as exemplified by talc, calcium carbonate, calcium sulfate, magnesium hydroxide, basic magnesium carbonate, alumina, synthetic silica, calcium silicate, diatomaceous earth, aluminum hydroxide, clay, barium sulfate, titanium oxide, zinc oxide, zinc sulfide, satin white, silicon oxide, lithopone, etc.

The binder to be used is a material having the function of binding the above particles each other and/or the particles and ink-retaining layer, and may preferably be free from being dyed by the dyes like the above particles. Materials preferred as the binder include any of conventionally known materials as they can be used so long as they have the above functions, and, for example, there can be used as desired, one or more of resins such as polyvinyl alcohol, acrylic resins, a styrene/acrylate copolymer, polyvinyl acetate, an ethylene/vinyl acetate copolymer, starch, polyvinyl butyral, gelatin, casein, ionomers, gum arabic, carboxymethyl cellulose, polyvinyl pyrrolidone, polyacrylamide, polyurethane, melamine resins, epoxy resins, styrene-butadiene rubber, urea resins, phenol resins, α-olefin resins, chloroprene, and nitrile rubbers.

For the purpose of improving the above functions as the ink-transporting layer, various additives as exemplified by surface active agents, penetrants, fluorescent dyes, coloring dyes, etc. may optionally be further added to the ink-transporting layer.

Mixing ratio (weight ratio) of the above particles and binders may preferably be in the range of particles/binder=from 1/5 to 50/1, more preferably in the range of from ⅓ to 20/1. In this mixing ratio, an excessively large proportion for the binder may make less the cracks or through-holes in the ink-transporting layer, resulting in a decrease in ink-absorption effect. In the mixing ratio also, an excessively large proportion for the particles may cause insufficient binding between particles and particles or the ink-retaining layer and particles, resulting in insufficiency in the strength of the ink-transporting layer and making it impossible to form the ink-transporting layer.

The thickness of the ink-transporting layer depends on the quantity of ink droplets, but may range from 1 to 300 μm, preferably from 2 to 200 μm, and more preferably from 3 to 80 μm.

Next, the ink-retaining layer, which is non-porous and capable of substantially capture inks or dyes to produce colors, is a layer to absorb and capture the dyes in inks having passed through the ink-transporting layer, and retain them substantially permanently.

The ink-retaining layer is required to have stronger absorptivity than the ink-transporting layer. This is because if the absorptivity of the ink-retaining layer is weaker than the absorptivity of the ink-transporting layer, the inks applied on the surface of the ink-transporting layer may stagnate in the ink-transporting layer when they pass through the ink-transporting layer and the lead of inks reach the ink-retaining layer, following that the inks penetrate and diffuse too much at the interface between the ink-transporting layer and ink-retaining layer in the lateral direction inside the ink-transporting layer. As a result, the resolution of recorded images is lowered, which prevents forming recorded images of high quality.

In instances in which the recorded images are viewed from the opposite side to the recording surface as previously mentioned, the ink-retaining layer may preferably be light-transmissive.

The ink-retaining layer satisfying the above requirements may preferably be constituted of light-transmissive resins capable of adsorbing the dyes and/or light-transmissive resins having solubility and swelling property to inks.

For example, when a water-based ink containing acidic dyes or direct dyes as the dyes is used, the ink-retaining layer may preferably be constituted of resins having adsorptivity to the above dyes, as exemplified by water-soluble or hydrophilic polymers having the swelling property to the water-based ink. There is no particular limitation in the materials constituting the ink-retaining layer as long as they have the functions of absorbing and capturing inks, can form a non-porous layer, and are light-transmissive.

The thickness of the ink-retaining layer may be satisfactory if it is enough to absorb and capture ink, and it depends on the quantity of ink droplets. It, however, may range from 1 to 70 μm, preferably 2 to 50 μm, and more preferably from 3 to 20 μm.

The materials constituting the ink-retaining layer may be any materials so long as they can absorb water-based inks and retain the dyes contained in inks, but may preferably be prepared from water-soluble or hydrophilic polymers considering that inks are mainly water-based inks. Such water-soluble or hydrophlic polymers may include, for example, natural resins such as albumin, gelatin, casein, starch, cationic starch, gum arabic and sodium alginate; synthetic resins such as carboxymethyl cellulose, hydroxyethyl cellulose, polyamide, polyacrylamide, polyethyleneimine, polyvinyl pyrrolidone, quaternized polyvinylpyrrolidone, polyvinyl pyridinium halide, melamine resins, phenol resins, alkyd resins, polyurethane, polyvinyl alcohol, ionically modified polyvinyl alcohol, polyester and sodium polyacrylate; preferably, hydrophilic polymers made water-insoluble by cross-linking of any of these polymers, hydrophilic and water-insoluble polymer complexes comprising two or more polymers, and hydrophilic and water-insoluble polymers having hydrophilic segments; etc. For the purpose of improving the above functions as the ink-retaining layer, various additives as exemplified by surface active agents, water-resisting agents, organic and inorganic pigments, etc. may optionally be further added to the ink-retaining layer.

Methods of forming the ink-retaining layer and the ink-transporting layer on the substrate may preferably include a method in which any of the materials set out in the above as preferred examples are dissolved or dispersed in a suitable solvent to prepare a coating solution, and the resulting coating solution is applied on the substrate by a known coating process such as roll coating, rod bar coating, spray coating or air knife coating, followed immediately by drying, or alternatively a method in which any of the above materials are coated on the substrate by hot melt coating, or a sheet is separately formed from any of the above materials in advance and the resulting sheet is laminated on the substrate.

When the ink-retaining layer is provided on the substrate, it is preferred to strengthen the adhesion between the substrate and the ink-retaining layer by forming, for example, an anchor coat layer, to eliminate gap therebetween.

Presence of a gap between the substrate and ink-retaining layer may cause irregular reflection on the recorded-image-viewing surface to substantially lower the image optical density, undesirably.

In the recording process of the present invention, the inks to be applied for the formation of images on the specific recording medium as described above may be those known by themselves, as exemplified by water-soluble dyes typified by direct dyes, acidic dyes, basic dyes, reactive dyes, food colors, etc., which are particularly suited as inks for the ink-jet system. Those preferred as giving images that may satisfy the fixing performance, color-forming performance, sharpness, stability, light-resistance and other required performances when used in combination with the above recording medium may preferably include, for example, direct dyes such as;

C. I. Direct Black 17, 19, 32, 51, 71, 108, 146;
C. I. Direct Blue 6, 22, 25, 71, 86, 90, 106, 199;
C. I. Direct Red 1, 4, 17, 28, 83;
C. I. Direct Yellow 12, 24, 26, 86, 98, 142;
C. I. Direct Orange 34, 39, 44, 46, 60;
C. I. Direct Violet 47, 48;
C. I. Direct Brown 109; and
C. I. Direct Green 59;

and acidic dyes such as

C. I. Acid Black 2, 7, 24, 26, 31, 52, 63, 112, 118;
C. I. Acid Blue 9, 22, 40, 59, 93, 102, 104, 113, 117, 120, 167, 229, 234;
C. I. Acid Red 1, 6, 32, 37, 51, 52, 80, 85, 87, 92, 94, 115, 180, 256, 317, 315;
C. I. Acid Yellow 11, 17, 23, 25, 29, 42, 61, 71;
C. I. Acid Orange 7, 19; and
C. I. Acid Violet 49.

Besides these, also usable are;

C. I. Basic Black 2;
C. I. Basic Blue 1, 3, 5, 7, 9, 24, 25, 26, 28, 29;
C. I. Basic Red 1, 2, 9, 12, 13, 14, 37;
C. I. Basic Violet 7, 14, 27;
C. I. Food Black 1, 2; etc.

The above examples of dyes are those particularly preferable for the inks applicable in the recording process of the present invention, and the dyes for use in the inks used in the present invention are by no means limited to these.

Such water-soluble dyes are used generally in the proportion of about 0.1 to 20% by weight in conventional inks, and may be used also in the same proportion in the present invention.

The solvent suitable for use in the inks used in the present invention is water or a mixed solvent of water with a water-soluble organic solvent. Particularly suited is a mixed solvent of water with a water-soluble organic solvent, containing as a water-soluble organic solvent a polyhydric alcohol having the effect of preventing the drying of inks. As for the water, preferred is not to use the ordinary water containing various ions but to use deionized water. The water-soluble organic solvent used by mixing it with water may include, for example, alkyl alcohols having 1 to 4 carbon atoms such as methyl alcohol, ethyl alcohol, n-propyl alcohol, isopropyl alcohol, n-butyl alcohol, sec-butyl alcohol, tert-butyl alcohol and isobutyl alcohol; amides such as dimethylformamide and dimethylacetamide; ketones or ketoalcohols such as acetone and diacetone alcohol; ethers such as tetrahydrofuran and dioxane; polyalkylene glycols such as polyethylene glycol and polypropylene glycol; alkylene glycols comprising an alkylene group having 2 to 6 carbon atoms, such as ethylene glycol, propylene glycol, butylene glycol, triethylene glycol, 1,2,6-hexanetriol, thiodiglycol, hexylene glycol and diethylene glycol; glycerol; lower alkyl ethers of polyhydric alcohols, such as ethylene glycol methyl (or ethyl) ether, diethylene glycol methyl (or ethyl) ether and triethylene glycol monomethyl (or ethyl) ether; N-methyl-2-pyrrolidone, 1,3-dimethyl-2-imidazolidinone, etc. Of these many water-soluble organic solvents, preferred are polyhydric alcohols such as diethylene glycol and lower alkyl ethers of polyhydric alcohols such as triethylene glycol monomethyl (or ethyl) ether.

The above water-soluble organic solvents may be contained in the inks generally in an amount of from 0 to 95% by weight, preferably from 10 to 80% by weight, and more preferably from 20 to 50% by weight, based on the total weight of inks.

In addition to the above components, the inks used in the present invention may optionally also contain surface active agents, viscosity modifiers, surface-tension modifiers, etc.

The ink-jet systems employed in the present invention are described, for example, in IEEE Transactions on Industry Applications, Vol. JA-13, No. 1, Mar. 1977, and Nikkei Electronics, the Apr. 19, 1976 issue, the Jan. 29, 1973 issue and the May 6, 1974 issue. The systems described in these are suited for the process of the present invention.

It is also possible to effectively use the ink-jet system described in Japanese Patent Laid-open Publication No. 59936/1979, in which the ink subjected to the action of heat energy undergoes an abrupt volume change and the ink is ejected from nozzles by the action attributable to this change in state.

The ink-jet recording process of the present invention, comprising carrying out the recording by using the specific recording medium as previously described and the inks and ink-jet system as described above, is characterized in that each of plural ink dots that form unicolored and mixedly colored areas on the recording medium is formed by a plurality of ink droplets applied in superposition from the ink-transporting layer side. More specifically, in the instance where color images with a high recording density are formed (particularly using a plurality of inks having different hues) only one droplet of the ink of the corresponding color is applied to the part at which one of the three primary colors is presented in monochromes. To obtain neutral tints, two to four ink droplets, depending on color hues, are applied, and thus the quantity of ink applied varies for every dot. As a result, the quantity of ink reaching the ink-retaining layer will also vary depending on the properties of the recording medium to be used, and moreover the inks ejected from one nozzle in one time is in a small quantity, so that there have been involved the problem that the inks form color insufficiency, the inks are mixed with insufficiently, or the dot shapes are unsatisfactory. However, the inks can be fed to the ink-retaining layer in a sufficient quantity and with substantial uniformity as a whole if, for example, the number of the ink droplets applied is made to be two or more even at the unicolored areas, approximating to, or making same with, the number of the ink droplets applied in maximum, namely four. Thus, good color formation, mixing of colors, dot shapes and so forth can be achieved without causing any problems mentioned above.

As illustrated in FIG. 1 ink recording medium 10 has a permeable ink-transporting layer 12 and an ink-retaining layer 14. Recording heads (not shown) eject droplets which impact the recording medium. Two droplets are applied at the same site, a black droplet 16 and a colorless droplet 18.

When the respective dots are formed on the recording surface of the recording medium, any methods may be employed for applying two or more ink droplets in superposition, without any particular limitation. There may be used, as an example, a method in which the nozzles for ejecting inks of respective colors are provided in plurality for each color, and a plurality of, for example, two, three or four ink droplets are applied at the same site or in the vicinity thereof, and a method in which ink-jet nozzles are scanned twice or more.

However, as the above methods may possibly complicate an apparatus or make troublesome the handling thereof, preferred is a method in which one or more nozzles common to the respective colors are provided and an ink common to the respective colors are ejected through this nozzle or nozzles. Here, a colorless ink may preferably be used as the common ink.

The colorless ink mentioned in the present invention refers to water, an organic solvent, or a mixture of these, but preferred is a liquid having the same liquid properties as a liquid medium for the inks as described above. Particularly preferred is a liquid having the composition such that only dyes have been removed from the inks of respective colors. Employment of such colorless ink which is common to the respective colors can bring about no complicacy of apparatus or no troublesomeness in operation, without any limitation in the order of the shooting of inks, and makes it possible to freely feed inks not only to the unicolored areas but also to the intermediary areas at which two or more ink droplets are applied.

The above colorless ink may not be perfectly colorless, and may be colored in pale tone to a certain extent. Employment of such an ink of pale color makes it possible to correct color tone of the whole of the images obtained. For example, in instances where proper color images are to be formed according to information signals from an original copy excessively strong in a particular color as a whole, a pale color ink that is in a complementary relationship may be used as the above colorless ink, thereby making some good use for the correction of tone of the whole.

In the recording process of the present invention as described above, where the ink-applying surface and the viewing surface are in obverse and reverse relationship, it is necessary to use an apparatus that can print mirror image letters when letters are printed. However, in the recording medium used in the present invention, it is also possible to make transparent the ink-transporting layer by post-treatment such as heating to view images by a transmission system. Accordingly, in such an instance, letters or the like can be recorded in an ordinary state.

According to the process of the present invention constituted as described above, the color images formed have superior effect that has not been hitherto obtained, when the recorded images are viewed from the opposite surface to the ink-applying surface, i.e., from the ink-retaining layer side or substrate side, although it is not impossible to view the recorded images from the surface on which the recording is performed with use of ink as in the case of ordinary paper.

In particular, of the color images formed, the part of the hue other than the monochromes corresponding to the three primary colors, in other words, the area at which a plurality of primary color inks are applied and neutral tints thereof are produced can have color tones sufficiently matched to the desired color tones, exhibiting superior color performances. For example, at areas in which cyan ink and yellow ink are color-mixed, neutral tints corresponding to the mixing ratio thereof can be sufficiently exhibited. The same applies also in the areas in which cyan ink and magenta ink, or magenta ink and yellow ink are mixed to form color. Accordingly, the color images according to the process of the present invention can achieve good color-forming performances as a whole over the higher density areas to the lower density areas, and can sufficiently satisfy the color reproducibility from an original copy.

Also, in a instance which is not in accordance with the present invention, the inks are applied in small amounts at areas having a lower image density, so that it has sometimes occurred that the inks do not sufficiently reach to the ink-retaining layer, resulting in unsatisfactory continuity of density. However, according to the present invention, even the inks applied in a small quantity can sufficiently reach to the ink-retaining layer to have superior density continuity from pale colors to dense colors.

In contrast, in a process which is not in accordance with the present invention, the color-forming of neutral tints at the mixedly colored area and the color-forming at the low density area are unstable with no color-forming of the neutral tints corresponding to the quantity of the inks to be mixed, resulting in insufficient reproducibility for the colors of an original copy and unclear color tones as a whole for the color images formed. This remarkably tends to occur particularly at the low density areas to lack the continuity of density.

Decline of resolution can also be very small as compared with an instance where inks are applied in a quantity corresponding to plural droplets by one droplet in order to apply plural minute ink droplets at the same site of the recording surface or in the vicinity thereof. Namely, the process of the present invention is suited for forming images having a high recording density of 200×200 DPI or more.

The effect as stated above is presumed by the present inventors to be obtainable because, even at the areas where inks of two or more colors are mixed or the areas where inks are applied only in a small quantity of ink, the ink applied by a second droplet re-dissolves the inks stagnating in the ink-transporting layer near the ink-retaining layer and the dyes retained in the ink-retaining layer, so that the dyes are sufficiently mixed and these inks and dyes are sufficiently transported to the ink-retaining layer.

In instances in which the light-transmissive substrate is used as a substrate, the gloss, water resistance, weatherability and abrasion resistance can be further imparted to the recorded images in addition to the above effect originating from the light-transmitting property possessed by the substrate.

The color images obtained by the process of the present invention are greatly superior in the optical density of recorded images and the operation efficiency at the time of the recorded-image formation.

The present invention will be specifically described on the bases of Reference Examples, Examples and Comparative Examples. In the following description, "%" or "part(s)" are by weight unless particularly mentioned.

REFERENCE EXAMPLE 1

Preparation of Recording Medium

Using polyethylene terephthalate film (75 μm thick; available from Toray Industries, Inc.) as a light-transmissive substrate, Composition A shown below was coated on this substrate by means of a bar coater to give a dried coat thickness of 8 μm, followed by drying in a drying oven for 10 minutes at 140° C.

| Composition A | |
|---|---|
| Cationically modified polyvinyl alcohol (PVA-C-318-2A; available from Kuraray Co., Ltd.; a 10% aqueous solution) | 50 parts |
| Water-soluble polyester type polyurethane (Elastron E-37; available from Dai-ichi Kogyo Seiyaku Co., Ltd.; a 25% aqueous solution) | 2.5 parts |
| Catalyst (Elastron Catalyst 32; available from Dai-ichi Kogyo Seiyaku Co., Ltd.) | 0.2 part |

Composition B shown below was further coated thereon by means of a bar coater to give a dried coat thickness of 60 μm, followed by drying in a drying oven for 5 minutes at 140° C.

| Composition B | |
|---|---|
| Polymethyl methacrylate resin (Microsphere M-100; available from Matsumoto Yushi-Seiyaku Co., Ltd.; | 100 parts |
| Acrylic resin (Boncoat 4001; available from Dainippon Ink & Chemicals, Incorporated; solid content: 50%) | 20 parts |
| Sodium dioctyl sulfosuccinate (Pelex OT-P; available from Kao Corporation; solid content: 70% | 0.5 part |
| Water | 50 parts |

The recording medium thus obtained in this Reference Example was white and opaque.

REFERENCE EXAMPLE 2

Preparation of Recording Medium

Using as a light-transmissive substrate the polyethylene terephthalate film used in Reference Example 1, Composition C shown below was coated on this substrate by means of a bar coater to give a dried coat thickness of 10 μm, followed by drying in a drying oven for 12 minutes at 100° C.

Composition C

Polyphenylacetoacetal (available from Sekisui Chemical Co., Ltd.; a 10% water/ethanol/butanol solution)

Composition D shown below was further coated thereon by means of a bar coater to give a dried coat thickness of 40 μm, followed by drying in a drying oven for 10 minutes at 140° C.

| Composition D | |
|---|---|
| Urea resin (Organic Filler; available from Nippon Kasei Chemical Co., Ltd.) | 100 parts |
| Butyral resin (S-lec BH-3, available from Sekisui Chemical Co., Ltd.) | 50 parts |
| Sodium dioctyl sulfosuccinate (Pelex OT-P; available from Kao Corporation; solid content: 70%) | 2 parts |
| Ethylene glycol monoethyl ether (available from Kishida Chemical Co., Ltd.) | 1,000 parts |

The recording medium thus obtained in Reference Example was white and opaque.

EXAMPLE 1

Using five kinds of inks shown below, the recording as shown below was performed on the recording medium of the above Reference Example 1, by use of a recording apparatus comprising an on-demand type ink-jet recording head that ejects inks by the aid of the pressure of bubbles generated with a heat resistance element.

| | |
|---|---|
| Colorless ink | |
| Diethylene glycol | 15 parts |
| Water | 85 parts |
| Yellow ink | |
| C.I.; Acid Yellow 86 | 2 parts |
| Diethylene glycol | 15 parts |
| Water | 85 parts |
| Magenta ink | |
| C.I. Acid Red 92 | 2 parts |
| Triethylene glycol | 15 parts |
| Water | 85 parts |
| Cyan ink | |
| C.I. Direct Blue 9 | 2 parts |
| Diethylene glycol | 15 parts |
| Nonionic surface active agent | 0.5 part |
| Water | 85 parts |
| Black ink | |
| C.I. Direct Black 19 | 2 parts |
| Polyethylene glycol #300 | 15 parts |
| Water | 85 parts |

(1) Recording was made once with cyan ink (droplet diameter: 60 μm) so as to give a recording density of 200×200 DPI (dots per inch), and subsequently recording was made three times with the same kind of inks at the same site (in total, 4 droplets of the same kind of inks were applied at the same site).

(2) Recording was made once with cyan ink (droplet diameter: 60 μm) so as to give a recording density of 200×200 DPI, and subsequently recording was made twice with the same kind of inks at the same site (in total, 3 droplets of the same kind of inks were applied at the same site).

(3) Recording was made once with cyan ink (droplet diameter: 60 μm) so as to give a recording density of 200×200 DPI, and subsequently recording was made once with the same kind of inks at the same site (in total, 2 droplets of the same kind of inks were applied at the same site).

EXAMPLE 2

The recording as shown below was performed on the recording medium of the above Reference Example 1.

(1) Recording was made once with black ink (droplet diameter: 60 μm) so as to give a recording density of 200×200 DPI, and subsequently recording was made three times with colorless ink (droplet diameter: 60 μm) at the same site (in total, 4 droplets of inks were applied at the same site).

(2) Recording was made once with black ink (droplet diameter: 60 μm) so as to give a recording density of 200×200 DPI, and subsequently recording was made twice with colorless ink (droplet diameter: 60 μm) at the same site (in total, 3 droplets of inks were applied at the same site).

(3) Recording was made once with black ink (droplet diameter: 60 μm) so as to give a recording density of 200×200 DPI, and subsequently recording was made once with colorless ink (droplet diameter: 60 μm) at the same site (in total, 2 droplets of inks were applied at the same site).

EXAMPLE 3

Recording was performed on the recording medium of the above Reference Example 2 in the same manner as in Example 1 except for the recording density of 300×300 DPI and to droplet diameter of 40 μm.

EXAMPLE 4

Recording was performed on the recording medium of the above Reference Example 2 in the same manner as in Example 2 except for the recording density of 300×300 DPI and the droplet diameter of 40 μm.

EXAMPLE 5

Recording was performed on the recording medium of the above Reference Example 1 in the same manner as in Example 1 except for the recording density of 400×400 DPI and the droplet diameter of 30 μm.

EXAMPLE 6

Recording was performed on the recording medium of the above Reference Example 1 in the same manner as in Example 2 except for the recording density of 400×400 DPI and the droplet diameter of 30 μm.

COMPARATIVE EXAMPLE 1

On the recording medium of the above Reference Example 1, recording was made once with cyan ink (droplet diameter: 60 μm) so as to give a recording density of 200×200 DPI.

COMPARATIVE EXAMPLE 2

On the recording medium of the above Reference Example 1, recording was made once with cyan ink (droplet diameter: 76 μm) so as to give a recording density of 200×200 DPI.

COMPARATIVE EXAMPLE 3

On the recording medium of the above Reference Example 2, recording was made once with black ink (droplet diameter: 40 μm) so as to give a recording density of 300×300 DPI.

COMPARATIVE EXAMPLE 4

On the recording medium of the above Reference Example 2, recording was made once with black ink (droplet diameter: 50 μm) so as to give a recording density of 300×300 DPI.

COMPARATIVE EXAMPLE 5

On the recording medium of the above Reference Example 1, recording was made once with black ink (droplet diameter: 30 μm) so as to give a recording density of 400×400 DPI.

COMPARATIVE EXAMPLE 6

On the recording medium of the above Reference Example 1, recording was made once with black ink (droplet diameter: 38 μm) so as to give a recording density of 400×400 DPI.

In regard to the records thus obtained in Examples and Comparative Examples, tests and evaluation were carried out to examine whether or not they are fit for what are aimed in the present invention according to methods (1) and (2) shown below.

(1) Image optical density (O.D.) was measured on ink recorded areas from the ink-applying surface side (A) and the image-viewing surface side (B) with use of Macbeth Densitometer RD 918.

(2) In respect of the resolution of images, the ink dots recorded on the recording mediums were observed by use of an optical microscope, and it was evaluated according to a four rank system to regard the best as AA, and the following as A, B and C in order.

Overall evaluation was made based on the results of the above. Results obtained are shown in Table 1.

TABLE 1

| | Example 1 | | | Example 2 | | | Comparison Examples | |
|---|---|---|---|---|---|---|---|---|
| | (1) | (2) | (3) | (1) | (2) | (3) | 1 | 2 |
| | | | | Image density: | | | | |
| (A) | 1.08 | 1.05 | 0.92 | 0.80 | 0.61 | 0.49 | 0.86 | 0.90 |
| (B) | 1.90 | 1.72 | 1.51 | 1.78 | 1.60 | 1.43 | 1.18 | 1.50 |
| | | | | Resolution: | | | | |
| | B | A | A | B | A | A | A | C |
| | | | | Overall evaluation: | | | | |
| | A | A | A | A | A | A | C | C |

| | Example 3 | | | Example 4 | | | Comparison Examples | |
|---|---|---|---|---|---|---|---|---|
| | (1) | (2) | (3) | (1) | (2) | (3) | 3 | 4 |
| | | | | Image density: | | | | |
| (A) | 1.09 | 0.99 | 0.90 | 0.72 | 0.60 | 0.47 | 0.40 | 0.42 |
| (B) | 1.85 | 1.68 | 1.45 | 1.80 | 1.62 | 1.40 | 1.10 | 1.42 |
| | | | | Resolution: | | | | |
| | A | A | A | A | A | AA | A | C |
| | | | | Overall evaluation: | | | | |
| | A | A | A | A | A | A | C | C |

| | Example 5 | | | Example 6 | | | Comparison Examples | |
|---|---|---|---|---|---|---|---|---|
| | (1) | (2) | (3) | (1) | (2) | (3) | 5 | 6 |
| | | | | Image density: | | | | |
| (A) | 0.95 | 0.91 | 0.87 | 0.85 | 0.81 | 0.77 | 0.65 | 0.85 |

TABLE 1-continued

| | | | | | | | | |
|---|---|---|---|---|---|---|---|---|
| (B) | 1.80 | 1.62 | 1.40 | 1.72 | 1.56 | 1.35 | 1.04 | 1.36 |
| | | | Resolution: | | | | | |
| | A | A | AA | A | A | AA | A | C |
| | | | Overall evaluation: | | | | | |
| | A | A | A | A | A | A | C | C |

EXAMPLE 7

On the recording medium of the above Reference Example 2, recording was made once with cyan ink (droplet diameter: 30 μm) so as to give a recording density of 400×400 DPI, and subsequently recording was made once with the same kind of ink at the same site (in total, 2 droplets of the same kind of inks were applied at the same site). Recording was further made once with cyan ink (droplet diameter: 30 μm) in the area contiguous to the above recording area so as to give a recording density of 400×400 DPI, and subsequently recording was made once with magenta ink (droplet diameter: 30 μm) at the same site (in total, 2 droplets of different kind of inks were applied at the same site).

EXAMPLE 8

On the recording medium of the above Reference Example 2, recording was made once with cyan ink (droplet diameter: 30 μm) so as to give a recording density of 400×400 DPI, and subsequently recording was made once with colorless ink (droplet diameter: 30 μm) at the same site (in total, 2 droplets of inks were applied at the same site). Recording was further made once with cyan ink (droplet diameter: 30 μm) in the area contiguous to the above recording area so as to give a recording density of 400×400 DPI, and subsequently recording was made once with magenta ink (droplet diameter: 30 μm) at the same site (in total, 2 droplets of different kind of inks were applied at the same site).

COMPARATIVE EXAMPLE 7

On the recording medium of the above Reference Example 2, recording was made once with cyan ink (droplet diameter: 30 μm) so as to give a recording density of 400×400 DPI. Recording was further made once with cyan ink (droplet diameter: 30 μm) in the area contiguous to the above recording area so as to give a recording density of 400×400 DPI, and subsequently recording was made once with magenta ink (droplet diameter: 30 μm) at the same site (in total, 2 droplets of different kind of inks were applied at the same site).

In regard to the records thus obtained in Examples and Comparative Examples, tests and evaluation to examine whether or not they are fit for what are aimed in the present invention were carried out according to method (3) shown below. Results of evaluation are shown in Table 2 below.

(3) In respect of the color-forming uniformity of images, the mutually adjacent unicolored area and mixedly colored area were observed visually, and it was evaluated according to a four rank system to regard the best as AA, and the following as A, B and C in order.

TABLE 2

| | Examples | | Comparative Example |
|---|---|---|---|
| | 7 | 8 | 7 |
| Image uniformity: | AA | AA | C |

EXAMPLE 9

On the recording medium of the above Reference Example 2, full color images were formed according to the process of the present invention so as to give the following, respectively.

(1) 200×200 DPI, ink droplet diameter: 60 μm
(2) 300×300 DPI, ink droplet diameter: 40 μm
(3) 400×400 DPI, ink droplet diameter: 30 μm

COMPARATIVE EXAMPLE 8

On the recording medium of the above Reference Example 2, full color images were formed according to the conventional process (only one ink droplet was applied to the unicolored area) so as to give (1) to (3) of Example 9.

In regard to the records thus obtained in Examples and Comparative Examples, tests and evaluation to examine whether or not they are fit for what are aimed in the present invention were carried out according to method (4) shown below. Results of evaluation are shown in Table 3 below.

(4) The color-forming uniformity of the whole images were observed visually, and was evaluated according to a four rank system to regard the best as AA, and the following as A, B and C in order.

TABLE 3

| | Examples 9 | | | Comparative Examples 8 | | |
|---|---|---|---|---|---|---|
| | (1) | (2) | (3) | (1) | (2) | (3) |
| Image uniformity: | AA | AA | AA | B | B | C |

I claim:

1. A process for recording an image comprising the step of:

applying a unicolor dot and a mixed color dot to a recording medium, the recording medium having at least an ink-transporting layer and an ink-retaining layer, said applying step including forming each of the unicolor dot and the mixed color dot with an amount of ink comprising approximately equal numbers of a plurality of ink droplets in superposition, said ink droplets having a diameter of 40 μm or less, and providing the ink droplets to said ink-retaining layer through said ink-transporting layer, wherein the respective amounts of ink reaching said ink-retaining layer and forming the unicolor dot and the mixed color dot approximate each other, and said applying step further including forming both of said dots in a density of 300×300 dots per inch or more.

2. The process of claim 1, wherein said inks are selected from the group consisting of cyan, magenta, yellow or black inks.

3. The process of claim 1, wherein said unicolor dot is formed with a plurality of ink droplets of the same color.

4. The process of claim 1, wherein said unicolor dot is formed with a colored ink droplet and a colorless ink droplet.

5. The process of claim 1, wherein said recording medium comprises said ink-transporting layer and said ink-retaining layer which are laminated on a light-transmissive substrate.

6. The process of claim 1, wherein both of said dots are in a density of 400×400 dots per inch or more.

7. A process for ink-jet recording a colored image comprising the step of:

applying a unicolor dot and a mixed color dot to a recording medium, the recording medium having at least an ink-transporting layer and an ink-retaining layer, said applying step including forming each of the unicolor dot and the mixed color dot with an amount of ink comprising approximately equal numbers of a plurality of ink droplets in superposition, said ink droplets having a diameter of 40 μm or less, and providing the ink droplets to said ink-retaining layer through said ink-transporting layer, wherein the respective amounts of ink reaching said ink-retaining layer and forming the unicolor dot and the mixed color dot approximate each other, and said applying step further including forming both of said dots in a density of 300×300 dots per inch or more.

8. The process of claim 7, wherein the inks are selected from the group consisting of cyan, magenta, yellow or black inks.

9. The process of claim 7, wherein said unicolor dot is formed with a plurality of ink droplets of the same color.

10. The process of claim 7, wherein said unicolor dot is formed with a colored ink droplet and a colorless ink droplet.

11. The process of claim 7, wherein said recording medium comprises said ink-transporting layer and said ink-retaining layer which are laminated on a light-transmissive substrate.

12. The process of claim 7, wherein both of said dots are in a density of 400×400 dots per inch or more.

* * * * *

UNITED STATES PATENT AND TRADEMARK OFFICE

CERTIFICATE OF CORRECTION

PATENT NO. : 5,140,339 Page 1 of 2

DATED : August 18, 1992

INVENTOR(S) : Higuma et al.

It is certified that error appears in the above-identified patent and that said Letters Patent is hereby corrected as shown below:

COLUMN 2:

Line 15, "to the" should be deleted;
Line 16, "to the" should be deleted;
Line 23, "ever" should read --even--; and
Line 31, "medium" should read --medium,--.

COLUMN 3:

Line 66, "quantity" should read --in quantity--; and
Line 67, "the" should be deleted.

COLUMN 4:

Line 15, "of" (first occurrence) should be deleted; and
Line 42, "applied," should read --applied--.

COLUMN 5:

Line 31, "is" should read --are--.

COLUMN 6:

Line 14, "capture" should read --capturing--.

COLUMN 9:

Line 19, "is" should read --are--; and "have" should read --has--;

UNITED STATES PATENT AND TRADEMARK OFFICE

CERTIFICATE OF CORRECTION

PATENT NO. : 5,140,339 Page 2 of 2

DATED : August 18, 1992

INVENTOR(S) : Higuma et al.

It is certified that error appears in the above-identified patent and that said Letters Patent is hereby corrected as shown below:

Line 20, "color insufficiency," should read --color with insufficiency,--;
Line 21, "with" should be deleted; and
Line 45, "are" should read --is--.

COLUMN 10:

Line 49, "a" should read --an--.

COLUMN 15:

Line 22, "kind" should read --kinds--.

COLUMN 16:

Line 24, "were" should read --was--.

Signed and Sealed this

Ninth Day of November, 1993

Bruce Lehman

*Attest:*

BRUCE LEHMAN

*Attesting Officer*

*Commissioner of Patents and Trademarks*